United States Patent [19]

Burns et al.

[11] 4,184,838

[45] Jan. 22, 1980

[54] IGNITER FOR OIL AND/OR GAS WELL DRILLING OPERATION

[75] Inventors: Kenneth L. Burns; Raymond E. Smith; Don J. Doughdrill, all of, Odessa, Tex.

[73] Assignee: Loffland Brothers Company, Tulsa, Okla.

[21] Appl. No.: 837,009

[22] Filed: Sep. 27, 1977

[51] Int. Cl.[2] ..... F23D 13/20

[52] U.S. Cl. ..... 431/202; 431/264

[58] Field of Search ..... 431/202, 5, 264; 23/277 C

[56] References Cited

U.S. PATENT DOCUMENTS

| | | | |
|---|---|---|---|
| 2,976,922 | 3/1961 | Bergman | 431/202 |
| 3,807,940 | 4/1974 | Juricek | 431/202 |
| 3,950,124 | 4/1976 | Berry | 431/264 |

FOREIGN PATENT DOCUMENTS

| | | | |
|---|---|---|---|
| 2326750 | 12/1974 | Fed. Rep. of Germany | 431/202 |

*Primary Examiner*—Edward G. Favors

*Attorney, Agent, or Firm*—Head & Johnson

[57] ABSTRACT

An igniter for flaring natural gas at the surface of the ground in spaced relation to an oil and/or gas well bore drilling operation wherein excessive gas pressure is encountered during the drilling operation, and comprising a relatively long pipe extending from the well head to a position somewhat remote therefrom for directing excess natural gas away from the well head, a spark plug assembly disposed at the outer end of the pipe and including constantly arcing spark plugs for flaring of the escaping gas and the open end of the pipe, and an annular passageway in the proximity of the spark plugs for providing an adequate supply of oxygen for facilitating the burning of the gas.

8 Claims, 6 Drawing Figures

IGNITER FOR OIL AND/OR GAS WELL DRILLING OPERATION

BACKGROUND OF THE INVENTION

1. Field of the Invention

This invention relates to improvements in igniters and more particularly, but not by way of limitation, to an igniter for flaring natural gas, and the like, during an oil and/or gas well bore drilling operation wherein excessive gas pressure is encountered.

2. Description of the Prior Art

In the drilling of an oil and/or well bore, excessive pressure conditions are frequently encountered, such as when the drill bit moves into a gas pocket or the like, and the excessive gas pressure must be relieved for facilitating the continuation of the drilling operation and reducing a hazardous condition. It is the usual practice to ignite or flare the gas at the surface of the ground, and the usual methods for igniting the gas which are in common usage today comprise the use of butane or diesel fuels burning at the proximity of any escaping gas for an igniting of the gas, or hot wires placed in the proximity of the escaping gas wherein the heat of the wires may ignite the gas. These methods have certain disadvantages in that the pressure of the escaping gas frequently blows out the butane or diesel fuel flame, thus interrupting the igniting operation. In the case of the hot wires, it is found that the heat may become sufficiently intense as to burn up the wires, which results in an inefficient flaring or igniting of the escaping gas.

SUMMARY OF THE INVENTION

The present invention contemplates a novel igniter for flaring or igniting escaping gases during the drilling of an oil and/or gas well bore wherein excessive gas pressures are encountered, and which has been particularly designed and constructed for overcoming the foregoing disadvantages. The novel device contemplates a relatively long pipe section, as for example approximately two hundred feet long, having one end thereof in communication with the interior of the well bore at the well head, or in the proximity of the surface of the well bore, for receiving any excess or escaping gas from the well bore within the pipe. The opposite end of the pipe is spaced from the well bore itself whereby the escaping gas is directed away from the well site for safety purposes. A spark plug assembly is operably connected at the outer end of the pipe and is provided with constantly arcing spark plugs wherein any gas escaping from the open outer end of the pipe is immediately ignited by the spark plugs. In order to facilitate the flaring or burning of the escaping gas, an annular passageway is provided around the outer periphery of the pipe and in the proximity of the spark plugs whereby an adequate supply of oxygen is provided directly at the site of the igniting of the gas. Of course, it is also preferable to provide a fire wall at the outer end of the pipe for protection of the spark plug assembly from the heat of the burning gas during the flaring operation. The novel igniter is simple and efficient in operation and economical and durable in construction.

DESCRIPTION OF THE PREFERRED EMBODIMENT

Figures 1, 4, 5, 6:
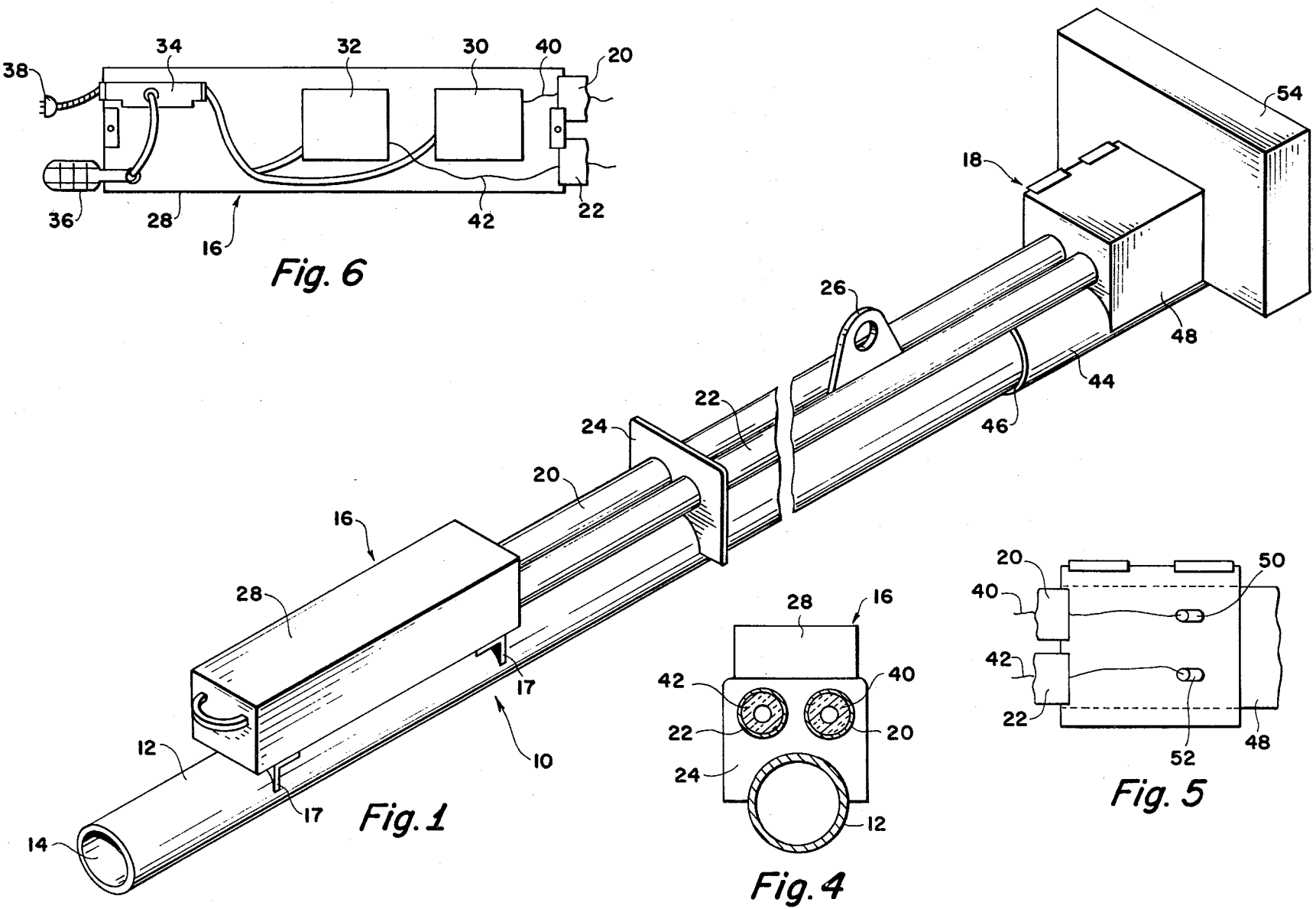
FIG. 1 is broken perspective view of an igniter embodying the invention.
FIG. 4 is a sectional view taken on line 4—4 of FIG. 2.
FIG. 5 is a detailed plan view of a spark plug box utilized in the igniter embodying the invention.
FIG. 6 is a schematic plan view of power supply box for the spark plug box of the igniter embodying the invention.

Referring to the drawings in detail, reference character 10 generally indicates an igniter comprising a relatively long pipe section 12 having one end 14 adapted to be disposed in the proximity of the well head (not shown) of an oil and/or gas well bore (not shown) in any well known manner (not shown) wherein the interior of the pipe 12 is in communication with the interior of the well bore for receiving gas pressure therefrom. A power source generally indicated at 16 is mounted on the outer periphery of the pipe 12 in any suitable manner, such as by a plurality of spaced bracket members 17 and is preferably disposed in the proximity of the end 14 of the pipe, but not limited thereto. A spark plug assembly generally indicated at 18 is suitably secured to the opposite end of the pipe 12 in any well known manner, and will be hereinafter more fully set forth. The power source 16 and spark plug assembly 18 are interconnected by a pair of substantially mutually parallel conduits 20 and 22 which extend substantially parallel to the longitudinal axis of the pipe 12 as clearly shown in the drawings. The conduits 20 and 22 are preferably supported on the pipe 12 by suitable baffles 24 longitudinally spaced along the length thereof, and it may be desirable to provide a pair of spaced apertured flanges or eyes 26, only one of which is shown in FIG. 1, secured to the outer periphery of the pipe 12 and extending radially outwardly therefrom interposed between the conduits 20 and 22 for facilitating handling of the apparatus 10 during installation or removal thereof during a well drilling operation.

The power source 16 is preferably contained within a suitable housing 28, which may be designed in any suitable manner of providing access to the interior thereof. A pair of suitable transformers 30 and 32 are disposed within the box 28 and are each electrically connected with a suitable connector box 34 which in turn is electrically connected with a suitable light 36 and is provided with the usual connector 38 for operable connection with a suitable source of electrical energy, as is well known. An electric cable 40 is operably connected with the transformer 30 and extends longitudinally through the conduit 20 and into the spark plug assembly 18 in a manner and for a purpose as will be hereinafter set forth. A similar electric cable 42 is operably connected with the transformer 32 and similarly extends longitudinally through the conduit 22 and into the spark plug assembly 18.

Figure 2:
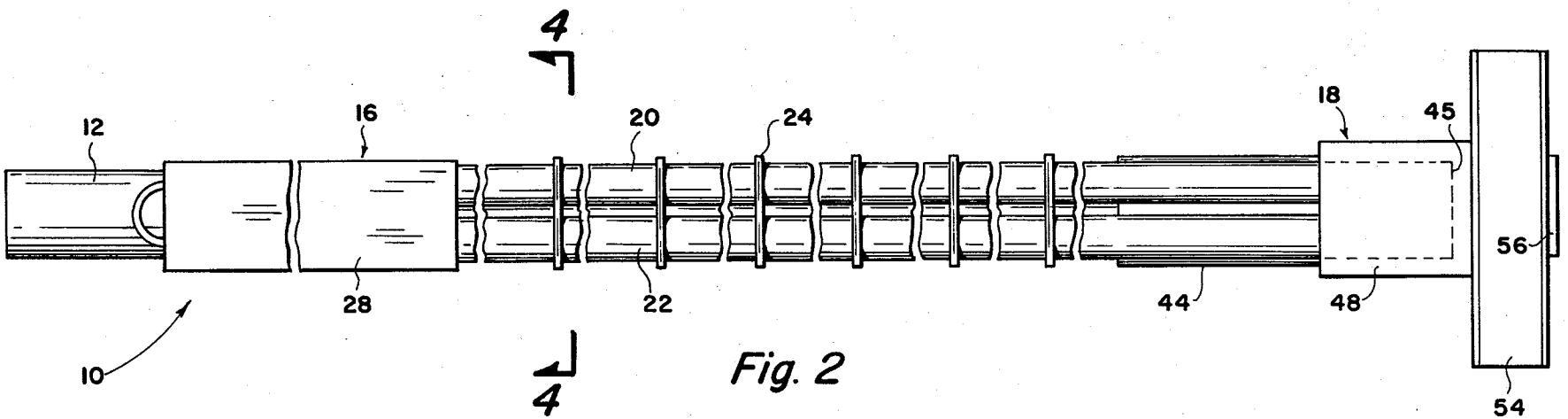
FIG. 2 is a broken plan view of an igniter embodying the invention.

The spark plug assembly 18 comprises a casing 44 disposed around the outer periphery of the pipe 12 in the proximity of the open outer end 45 thereof, and extends therebeyond, as particularly shown in FIG. 2. The casing 44 may be secured to the pipe 12 in any suitable manner (not shown) and is concentrically arranged with respect thereto to provide an annular passageway 46 therebetween whereby communication is established between the exterior of the pipe 13 and the area surrounding the open end 45 disposed within the casing 44. A suitable casing 48 is secured to the outer periphery of the casing 44 in any well known manner and may be of any desired construction providing access to the interior thereof. As shown in FIG. 5, a pair of constantly arcing spark plugs 50 and 52 are mounted in the housing 48, and so arranged that the gap of each spark plug extends into or is disposed in the interior of the casing 44, preferably in the proximity of the open end 45 of the pipe 12.

Figure 3:
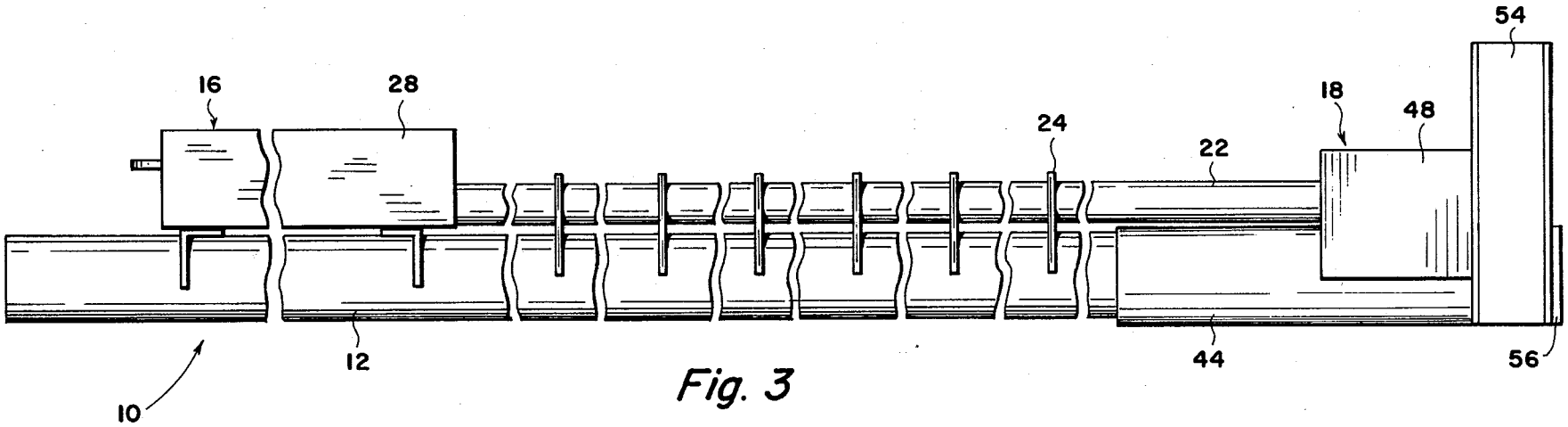
FIG. 3 is a broken side elevational view of an igniter embodying the invention.

The spark plug 50 is electrically connected with the cable 40, and the spark plug 52 is electrically connected with the cable 42 whereby the spark plugs are energized by the transformers 30 and 32, respectively, in the usual or well known manner, whereas two spark plugs are depicted herein it is to be understood that any suitable number may be utilized, as desired. It is preferable to provide a barricade or fire wall structure 54 between the outer end 56 (FIGS. 2 and 3) of the casing 44 and the housing 48 for protection of the apparatus 10 and personnel operating at the well bore site from any flame or burning gas which may be present at the open end 56 of the casing, as will be hereinafter set forth.

In use, the apparatus 10 is installed at the site of a drilling oil and/or gas well bore (not shown) as hereinbefore set forth whereby the end 14 of the pipe 12 is in communication with the interior of the well bore for receiving any excess gas pressure which may be present therein at any time during the well drilling operation. The power source 16 is operably connected with any suitable supply of electrical current by the connector 38 as is well known, and the transformers 30 and 32 are thus energized for constantly supplying electrical current to the spark plugs 50 and 52. The spark plugs 50 and 52 are thus constantly sparking, whether or not any gas to be ignited is present within the pipe 12.

In the event the drilling operation penetrates a gas pocket, or the like, and excessive gas pressure is encountered in the well bore, the gas flows out of the well bore due to the pressure, and passes into and through the interior of the pipe 12. As the gas is discharged from the open end 45 of the pipe 12, it is mixed or united with the oxygen supplied through the annular passageway 46, and the sparking of the spark plugs 50 and 52 ignites the gas for a flaring thereof. The heat of the flame, which may be intense, is directed in a direction away from the apparatus 10 by the firewall 54, thus providing protection for the apparatus, as well as personnel present at the side of the well drilling operation. The length of the pipe 12 is sufficient for directing the gas away from the well head in order that the flaring of the gas will not endanger the drilling equipment and for other safety purposes.

From the foregoing, it will be apparent that the present invention provides a novel igniter for flaring of excessive gas pressure during a well drilling operation. The novel device comprises a relatively long pipe section having one end in communication with the interior of the well bore and the opposite end somewhat remote disposed with respect to the well bore for discharging gas at a distance from the well bore. A spark plug assembly including constantly arcing spark plugs is disposed in the proximity of the outer end of the pipe and an adequate supply of oxygen is provided in the proximity of the discharge gas and the arcing spark plugs to provide an efficient igniting of the escaping gas. Firewall means is provided for protection of the apparatus and for other safety reasons for prolonging the useful life of the apparatus and increasing the efficient operation thereof.

Whereas the present invention has been described in particular relation to the drawings attached hereto, it should be understood that other and further modifications, apart from those shown or suggested herein may be made within the spirit and scope of this invention.

What is claimed is:

1. An igniter for flaring of excessive gas during an oil or gas well bore drilling operation and comprising an elongated pipe having one end in communication with the interior of the well bore for receiving gas pressure therefrom and the opposite outer end open for discharging said gas pressure, housing means secured to the pipe and shielding the outer end thereof, spark plug means disposed within the housing in the proximity of the said outer end of the pipe, power means, shielded electrical cable means operably connected between the power means and said spark plug means for activation thereof, and means providing a supply of oxygen at the said outer end of the pipe for mixing with the gas within the housing to assure an efficient igniting of the discharging gas passing the activated spark plug means.

2. An igniter as set forth in claim 1 wherein said spark plug means includes constantly arcing spark plug means having the gap thereof disposed in the path of the escaping gas for ignition thereof.

3. An igniter as set forth in claim 1 wherein said last mention means comprises casing means disposed concentrically around said pipe section in the proximity of said outer end thereof and extending therebeyond for providing an annular passageway communication between the exterior of the pipe and the said outer end thereof.

4. An igniter as set forth in claim 1 wherein the power means comprises transformer means mounted on the pipe and electrically connected with said electrical cable means for supplying electric current to the spark plug means.

5. An igniter as set forth in claim 4 wherein a pair of spaced mutually parallel conduit members extend between the power means and the spark plug means for encasing said electrical cable providing said electrical connection between the power means and spark plug means.

6. An igniter as set forth in claim 1 and including fire wall means disposed outboard of said housing and in the proximity of said outer end of the pipe for protection from the ignited gas.

7. An igniter for flaring of excessive gas pressure during the drilling operation of an oil and/or gas well bore and comprising an elongated pipe section having one end open to the inter of the well bore for receiving the gas pressure therefrom and the opposite outer end open for discharging said gas pressure from the pipe, a housing secured to the pipe for shielding the outer end thereof, casing means disposed concentrically around the outer periphery of the pipe in the proximity of the said outer end thereof and extending therebeyond and into the housing for providing an annular passageway communicating between the exterior of the pipe and the said outer end thereof, constantly arcing spark plug means disposed within the housing in the proximity of said outer end of the pipe and having the gap thereof extending into the casing in the proximity of the said outer end of the pipe, power supply means operably connectable with a source of electrical current, a pair of mutually parallel conduits extending longitudinally along the outer periphery of the pipe in spaced relation thereto and extending between the power supply means and the spark plug means, electrical cable means extending longitudinally through each conduit for electrically connecting said power means with said spark plug means for supplying electrical current for providing said constant arcing of said spark plug means whereby gas discharging from the said outer end of the pipe will be efficiently ignited for flaring.

8. An igniter as set forth in claim 7 and including fire wall means disposed outboard of said housing and in the proximity of said outer end of the pipe for protection from the ignited gas.

* * * * *